US005307119A

United States Patent [19]

Folkins et al.

[11] Patent Number: 5,307,119

[45] Date of Patent: Apr. 26, 1994

[54] METHOD AND APPARATUS FOR MONITORING AND CONTROLLING A TONER IMAGE FORMATION PROCESS

[75] Inventors: Jeffrey J. Folkins, Rochester; Cyril G. Edmunds, Webster, both of N.Y.

[73] Assignee: Xerox Corporation, Stamford, Conn.

[21] Appl. No.: 999,349

[22] Filed: Dec. 31, 1992

[51] Int. Cl.[5] ..... G03G 21/00

[52] U.S. Cl. ..... 355/208; 355/246; 355/275

[58] Field of Search ..... 355/271-276, 355/326, 327, 203, 208, 246; 118/653; 346/153.1, 157, 159; 430/42, 48

[56] References Cited

U.S. PATENT DOCUMENTS

| | | | |
|---|---|---|---|
| 4,026,643 | 5/1977 | Bergman | 355/246 |
| 4,220,699 | 9/1980 | Ishida et al. | 355/272 |
| 4,277,162 | 7/1981 | Kasahara et al. | 355/208 |
| 5,103,260 | 4/1992 | Tompkins et al. | 355/208 |
| 5,150,135 | 9/1992 | Casey et al. | 346/159 |
| 5,196,893 | 3/1993 | Nishise et al. | 355/271 |
| 5,212,522 | 5/1993 | Knapp | 355/208 |

FOREIGN PATENT DOCUMENTS

| | | | |
|---|---|---|---|
| 0087739 | 2/1978 | Japan | 355/203 |
| 0055675 | 3/1986 | Japan | 355/273 |
| 0198079 | 8/1991 | Japan | 355/275 |
| 0133082 | 5/1992 | Japan | 355/275 |

*Primary Examiner*—A. T. Grimley
*Assistant Examiner*—William J. Royer
*Attorney, Agent, or Firm*—Oliff & Berridge

[57] ABSTRACT

Attributes of a toner patch transferred from an imaging member (e.g., a photoreceptor or other charge-sensitive substrate) to a transfer member, such as an intermediate or electrostatic belt or drum, are measured. Measurement of attributes of the toner patch located on the transfer member can be used to monitor characteristics of the toner image formation process so that the toner development process can be appropriately controlled. These measurements can be used to improve the toner development process stability, and thus maintain superior print quality. The toner patch attributes measured include, for example, the voltage and the mass of the toner patch. Toner patch voltage is measured by an electrostatic voltmeter located adjacent to the transfer member. Toner patch mass is measured by one or more densitometers for measuring the developed toner patch mass, the transferred toner patch mass, and/or residual toner patch mass.

47 Claims, 5 Drawing Sheets

METHOD AND APPARATUS FOR MONITORING AND CONTROLLING A TONER IMAGE FORMATION PROCESS

BACKGROUND OF THE INVENTION

1. Field of the Invention

The present invention relates to a method and apparatus for monitoring and controlling toner image formation processes, and in particular, toner image formation processes in xerographic or ionographic type printing machines which utilize transfer members for transferring a toner image from an imaging member to a receiving material, such as paper.

2. Description of Related Art

A typical xerographic printing machine (such as a photocopier, laser printer, facsimile machine or the like) employs an imaging member (e.g., a photoreceptor) that is uniformly electrostatically charged, and then exposed to a light image corresponding to an image to be printed so that the imaging member is selectively discharged in accordance with the image. Thus, exposure of the imaging member records an electrostatic (latent) image on it corresponding to the informational areas contained within the image to be printed. This latent image is developed by bringing a developer material (liquid or powder) into contact with the latent image to form a toner image. The toner image recorded on the imaging member is then transferred to a receiving material such as paper either directly or via an intermediate transport member. The receiving material can be transported past the imaging member to receive the toner image by a transported past the imaging member to receive the toner image by a transport member such as, for example, an electrostatic belt or drum which presses the receiving material against the toner image on the imaging member to receive the toner image therefrom. Alternatively, the toner image can be transferred from the imaging member to an intermediate belt or drum which then further transfers the toner image to the receiving material. The developed toner image on the receiving material usually is then subjected to heat and/or pressure to permanently fuse the image to the receiving material.

In an ionographic printing machine, a latent image corresponding to an image to be printed is formed on an imaging member by an ion generating device which selectively propels ions toward the imaging member in accordance with an input signal to form the latent image on the imaging member. Development of the latent image into a toner image, and transfer of the toner image to a receiving material can proceed in a manner similar to that described above with respect to the xerographic printing machine.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in monocolor images, particularly when such images are halftone images.

It is known to monitor the developed mass per area (DMA) for a development process by using densitometers such as, for example, infrared densitometers (IRDs) to measure the mass of a toner patch formed on the imaging member. Although DMA permits one to monitor the manner in which toner is deposited onto the imaging member, it does not provide a complete picture of the image formation process because DMA does not take into account the efficiency with which toner is transferred from the imaging member to the receiving material (e.g., paper) which ultimately receives the final image. Conventional printing machines do not attempt to measure the toner transfer process (i.e., the process by which the toner image is transferred from the imaging member to the receiving material (paper sheet)) because transferring a control toner patch to a sheet of paper would necessitate the disposal of the sheet which cannot be done on a routine basis.

Another example of a process control which is monitored includes the developability. Developability is the rate at which development (toner mass/area) takes place. Developability is typically monitored (and thereby controlled) using densitometers (e.g., IRDs) and by measuring toner concentration (TC) in the developer housing. As described above, IRDs measure total developed mass (i.e., on the imaging member), which is a function of developability and electrostatics. Thus, the developability cannot be determined using IRDs alone because the electrostatics of the imaging member also affect the mass of toner deposited on the imaging member by a developer device. TC is measured by directly measuring the percentage of toner in the developer housing (which, as is well known, contains toner and carrier particles). However, the relationship between TC and developability is affected by other variables such as ambient temperature, humidity and the age of the toner. For example, a 3% TC results in different developabilities depending on the variables listed above. Thus, maintaining TC at a predetermined value does not ensure a desired developability.

Accordingly, the monitoring and control of the toner development process can be difficult and complicated. It is desirable to provide new and useful means for monitoring the toner development process so that the toner development process can be appropriately controlled.

SUMMARY OF THE INVENTION

It is an object of the present invention to improve the toner development process stability, and thus achieve and maintain higher print qualities.

In order to achieve the above and other objects, and to overcome the shortcomings set forth above, attributes of a toner patch transferred from an imaging member (e.g., a photoreceptor or other charge-sensitive substrate) to a transfer member, such as an intermediate or electrostatic belt or drum, are measured. Measurement of attributes of the toner patch located on the transfer member can be used to monitor the toner image formation and transfer processes so that the toner development process can be appropriately controlled. These measurements can be used to improve the toner development process stability, and thus maintain superior print quality.

In accordance with one embodiment of the present invention, the voltage of the toner patch located on the transfer member is measured. The measured toner patch voltage can be used to control various aspects of the toner development and transfer processes. Additionally, when the mass of the toner patch is known (e.g., by measuring the toner patch mass), the voltage and mass of the toner patch can be used to derive the charge to mass ratio of the toner (total charge of a toner particle/-mass of the toner particle). The derived charge to mass ratio can be used to control, for example, development, pre-transfer corona, and transfer setpoints used in printing machines.

The voltage of the toner patch can be measured using an electrostatic voltmeter (ESV) located adjacent to the transfer member. The toner patch mass can be measured either from the imaging member (i.e., prior to transfer of the patch to the transfer member) or from the transfer member after the toner patch is transferred to the transfer member.

In accordance with a second embodiment of the present invention, the mass of the toner patch transferred to the transfer member is measured using, for example, a densitometer located adjacent to the transfer member. The toner patch mass can be used to derive the transferred mass/area (TMA) for the toner development process. Thus, the amount of toner transferred to the transfer member from the imaging member can be directly measured for given set points used in the development process so that these set points can be appropriately controlled (adjusted) to provide a desired TMA.

Additionally, measurement of the mass of toner transferred to the transfer member in conjunction with measurement of the mass of toner located on the imaging member (either before or after transfer to the transfer member) permits the transfer efficiency (TE) of the development process to be determined. Knowledge of the transfer efficiency can be used to significantly improve toner development process control capability.

In accordance with another embodiment of the present invention, the mass of the toner patch located on the imaging member before and after transfer to the transfer member are measured to derive DMA, RMA (residual mass/area) and TE. A single densitometer, located downstream of the point where transfer of the image from the imaging member to the transfer member takes place, can be used in conjunction with a mechanism for moving the transfer member and imaging member apart from each other so that toner transfer can be selectively prevented, in order to measure and derive both DMA and RMA.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
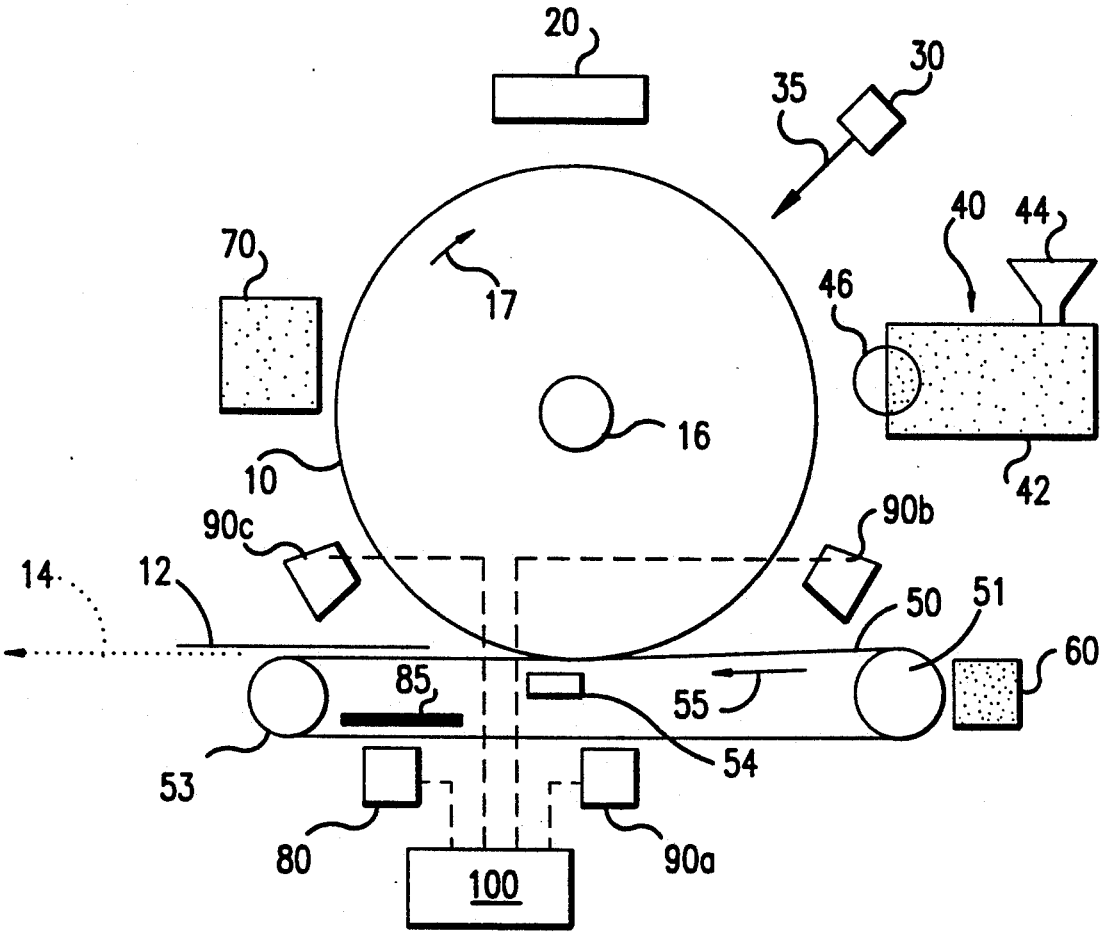
FIG. 1 is a schematic side view of pertinent portions of a xerographic printing machine having a photoreceptor drum-type imaging member and a belt-type transfer member.

The present invention preferably makes use of a transfer member, such as, for example, a belt or drum, used in some printing machines for transferring a toner image from an imaging member to a receiving material, such as, for example, a sheet of paper. Typically, the transfer member is either an electrostatic transfer member which is used to transfer the toner image from the imaging member directly to the sheet of paper which is conveyed past the imaging member by the electrostatic transfer member, or an intermediate transfer member which directly receives the toner image from the imaging member, and then transfers the toner image to the sheet of paper at a position spaced from the imaging member. Extensive patent literature exists regarding printing machines having electrostatic or intermediate transfer members. Additionally, some commercially available black-and-white and color printers include transfer members, such as, for example, Colorocs, the Panasonic FPC-1 and the Konica 8028/9028. In accordance with the present invention, a control toner patch is transferred directly from the imaging member to the transfer member (regardless of whether the transfer member is of the intermediate type, which usually receives toner images thereon, or of the electrostatic type, which usually does not receive toner images thereon) and its attributes (e.g., voltage potential, mass) are measured, so that information regarding the development process can be derived and possibly used to control set points of the development process.

The set points which may be controlled based on the information obtained by the monitoring process of the present invention include, for example:

a) the voltage potential to which a photoreceptor is charged by a charging device (e.g., a scorotron) in a xerographic printing machine;

b) the exposure levels used by exposure devices in a xerographic printing machine;

c) the intensity levels used by an ion generating device in an ionographic printing machine;

d) developer biases and TC used by toner developer devices;

e) voltage potentials used by the transfer members in transferring toner patches from the imaging member to the transfer member;

f) the frequency and/or amplitude of the developer housing bias;

g) the exposure algorithms used (e.g., by varying the line-width or the halftoning scheme); and h) the charging level or polarity of any pre-transfer corona treatment.

The information obtained by the monitoring process of the present invention can also be used for diagnostic purposes, for example, to aid in determining whether the photoreceptor, developer housing, carrier material or toner requires replacement, or whether there is some malfunction in the development or charging processes.

In accordance with a first embodiment of the present invention, the voltage of a control patch of toner transferred to the transfer member is measured using, for example, an ESV. The toner patch voltage can be used to provide information regarding the development and transfer processes. Additionally, when the mass of the toner patch is also known, the toner patch voltage can be used to derive the charge of the toner. The charge to mass ratio is a critical parameter which is important not only in the developer housing, but also in the transfer subsystem. It has been empirically determined that there is a monotonic relationship between the measured voltage of a solid area of toner and the average charge to mass ratio for a given toner. For example, a typical relationship for Xerox 4850 Red toner has been parameterized as voltage/charge-to-mass=4.3.Mass, for Mass<0.68 mg/cm$^2$, else=2.9+10.9.(Mass-0.68) (where mass, voltage and charge/mass are in units of mg/cm$^2$, volts, and $\mu$C/gm, respectively). Accordingly, for a known toner and under specific transfer conditions, the charge to mass ratio of the toner can be determined if the voltage and mass of the toner patch are measured. This charge state of the toner will be a function of both the original tribocharge of the toner from development as well as any charge modifications from any pre-transfer corona treatment and/or transfer/detack corona treatment and/or air corona breakdown from the stripping away of the transfer media from the photoreceptor. A knowledge of this final charge state of the toner can be used to modify and control the development, pre-transfer corona and transfer setpoints as described above.

In printing machines which include transfer members (e.g., endless transfer members such as drums or belts), a toner voltage measurement can be made for the toner patch after it has been transferred to the transfer member. This measurement can be made on transfer members which are at least somewhat conductive (a characteristic of most available transfer members) and which have a charge relaxation time shorter than the transport time (from the point of transfer of the toner patch to the transfer belt to the point where the toner patch passes the ESV). Since there will be virtually no residual voltages in these transfer members, measuring the voltage of a toner patch transferred to the transfer member will provide a measurement of the toner patch voltage potential unaffected by background contributions.

FIG. 1 illustrates a xerographic printing machine having a drum-type photoreceptor 10 which functions as an imaging member, and an electrostatic transfer belt 50 which functions as a transfer member for transferring toner images formed on photoreceptor 10 to a receiving material such as a paper sheet 12. Photoreceptor drum 10 is mounted about shaft 16 for rotation in the direction of arrow 17. As is well known, toner images are formed on photoreceptor 10 by first uniformly charging the photoreceptor surface to a predetermined voltage potential using a charging device 20. Charging device 20 can be, for example, a scorotron, corotron, or a di-corotron. After being uniformly charged, the photoreceptor surface can be selectively discharged by image-modulated light 35. Image-modulated light 35 can be provided, for example, from a ROS 30, or can be created by reflecting light from an original document directly onto photoreceptor 10, as is well known. Image-modulated light 35 forms a latent image on photoreceptor 10. The latent image is developed into a toner image using a developer device 40. Developer device 40 typically includes a housing 42 having toner particles and carrier particles therein. Toner is supplied to the developer device housing from, for example, a container 44 where the toner mixes with the carrier particles and becomes triboelectrically charged. The charged toner particles are then conveyed to the surface of photoreceptor 10 by, for example, a magnetic roller 46. The triboelectrically charged toner particles are then selectively attracted and adhered to the photoreceptor surface in accordance with the latent image thereon to form a toner image.

During regular printing, the toner image is then transferred to a sheet of paper 12 conveyed in the direction indicated by arrow 14 by electrostatic transfer belt 50 at a transfer point where drum 10 and belt 50 contact one another. Transfer belt 50 is provided around rollers 51, 53 which are driven so that belt 50 rotates in the direction of arrow 55. A transfer corotron 54 or other appropriate electrostatically charged transfer device is used to transfer the toner image to belt 50. A cleaning device 60 is conventionally provided to remove toner particles which inadvertently become adhered to the surface of belt 50. After transfer of the toner image, a cleaning device 70 removes any residual toner remaining on photoreceptor drum 10. Photoreceptor drum 10 is then discharged, for example, by an erase lamp (not shown). Sheet 12 is conveyed to a conventional fusing device which uses heat and/or pressure to permanently fuse the toner image to sheet 12. The process described above is then repeated for subsequent images.

The xerographic printing machine illustrated in FIG. 1 is a single color (e.g., black) printing machine. However, it is understood that the toner image transfer architecture illustrated in FIG. 1 can also be used in single-pass multicolor printers or in multi-pass multicolor printers. As is known, one class of color printer builds up multicolor images of toner on a photoreceptor and then transfer this multicolor toner image in one step. Within this class of color machines there are single-pass multicolor printers which have a plurality of sets of charging, exposing and developer devices, corresponding in number to the total number of colors to be formed, disposed around the periphery of the photoreceptor (imaging member). See, for example, U.S. Pat. Nos. 4,791,452; 4,998,139; and 4,833,503, the disclosures of which are incorporated herein by reference. As is also known, this class of color printers includes multi-pass multi-color printers which typically have a single charging and exposing device and a plurality of developer devices (corresponding in number to the total number of colors to be formed) disposed around a photoreceptor wherein the photoreceptor makes a single revolution for each color in the image (i.e, a four color image requires four photoreceptor revolutions). If a multi-pass multicolor printer includes a transfer member, the transfer member is selectively contacted with the photoreceptor only when all of the different colored toner images for a multicolor image are formed on the photoreceptor for transfer to the transfer member. Additionally, the cleaning device is also only selectively contacted with the photoreceptor only after all of the various colored toners are developed and transferred.

In accordance with the first embodiment of the present invention, a control toner patch is formed on photoreceptor 10, transferred to belt 50 (instead of onto a sheet of paper, usually conveyed by belt 50), and then the voltage potential of the toner patch located on belt 50 is measured. Preferably, an ESV 80 is provided adjacent to a surface of the transfer belt 50 for measuring the voltage of the control toner patch transferred to belt 50 from photoreceptor 10. As is known in the art, ESVs are capable of measuring the voltage of a surface located adjacent to the ESV. Since the ESV is used to measure the voltage potential of a toner patch in the present invention, the ESV must be of the non-contacting type. Vibrating element or ionization type ESVs (available, e.g., from Trek or NEC), for example, can be used to measure the voltage of a toner patch without contacting the toner patch.

A lower cost (although less accurate) ESV can be provided by spacing a conductive element, such as a plate of metal, a close distance away from transfer belt 50, and then measuring the charge flow to and from the conductive element as a change in voltage on the moving belt 50 capacitively induces varying currents in the conductive member. That is, since the transfer belt is made from a conductive (relaxable) material, areas of the transfer belt which are free of toner are guaranteed to be at a constant voltage (as long as sufficient time is provided for belt 50 to discharge as it moves to the location of ESV 80 from the point where the toner patch is transferred to belt 50). When this constant voltage is known, changes in the current induced in the conductive element when the charged toner patch passes by the conductive element can be used to determine the voltage of the toner patch.

Figure 2:
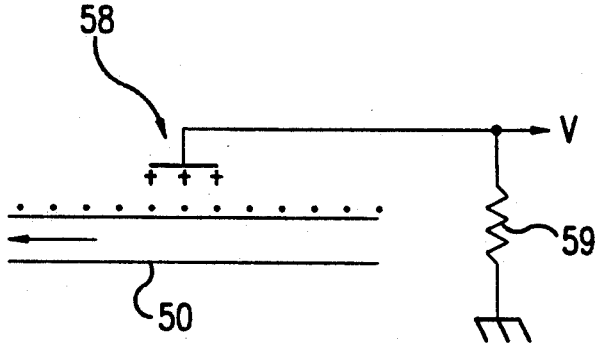
FIGS. 2 and 2A illustrate a lower cost ESV and a voltage induced therein when no toner patch is located adjacent thereto.
Figure 2A:
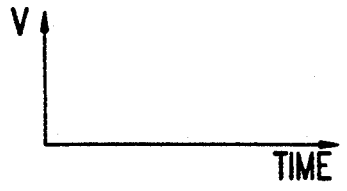
Figure 3:
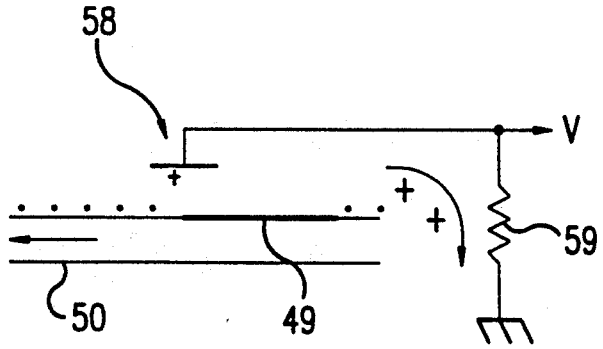
FIGS. 3 and 3A illustrate the ESV of FIG. 2 as an edge of a toner patch begins to pass by the ESV, and the voltage induced therein.
Figure 3A:
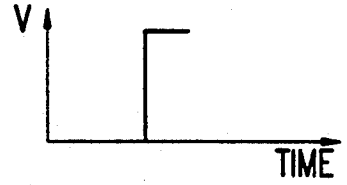
Figure 4:
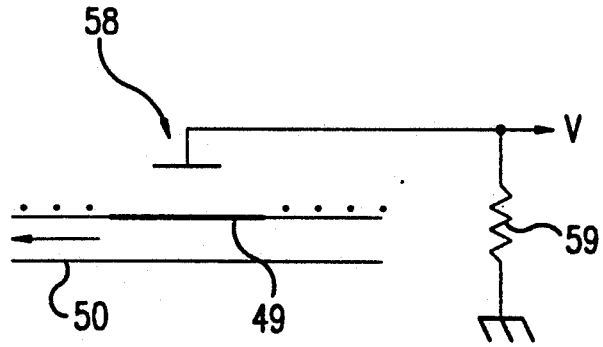
FIGS. 4 and 4A illustrate the ESV of FIG. 3 when located entirely over the toner patch, and the voltage induced therein.
Figure 4A:
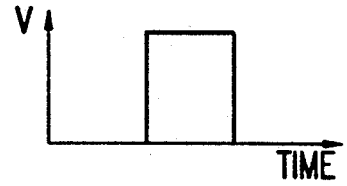

FIGS. 2–4A illustrate pertinent portions of this lower cost ESV, and the manner in which it can be used to measure the voltage potential of a toner patch. The conductive element (or electrode) 58 is located closely adjacent to a surface of transfer belt 50. When electrode 58 is located over a uniformly charged region of belt 50, no voltage is observed across resistor 59, as shown in FIG. 2A. As shown in FIGS. 3 and 3A, when an edge of a toner patch 49 begins to pass by electrode 58, the induced charge starts to leak off through resistor 59, producing a voltage. As shown in FIGS. 4 and 4A, when electrode 58 is fully over toner patch 49, the charge becomes constant and the observed voltage is again zero. When the other edge of toner patch 49 passes beneath electrode 58 (not shown), an equal but opposite voltage pulse is observed.

For a variety of reasons, the shape of the pulse is not perfectly rectangular, but assuming a rectangular pulse, the pulse height is:

$$V_O e_O I_e R v / I_a$$

wherein $V_O$ is the toner patch potential to be measured, $e_O$ is the permittivity of free space, $I_e$ is the length of electrode 58 (i.e., in the direction perpendicular to the motion direction of belt 50), R is the value of resistor 59, v is the photoreceptor speed, and $I_a$ is the gap between the transfer belt and the electrode 58. The pulse width is:

$$w_e / v$$

where $w_e$ is the width of electrode 58. Thus, the integrated area of the pulse is proportional to both the toner patch voltage potential $V_O$ and the electrode area, and inversely proportional to the gap. Preferably, the integrated area rather than the amplitude of the pulse is used to derive $V_O$, since it is less affected by noise. The area of the pulse can be determined using an integrating ammeter whose reading is then proportional to the toner patch voltage potential.

Preferably, a conductive back plate 85, which is maintained at a constant voltage, is located on the opposite side of and in contact with the transfer belt 50 from ESV 80 so that the background areas (i.e., areas of the transfer belt which do not contain toner) can be maintained at a predetermined fixed voltage level.

The toner patch voltage measured by ESV 80 is then provided to controller 100 which can be, for example, a microcomputer or microprocessor conventionally provided in printing machines. Controller 100 then uses the measured toner patch voltage to control set points used in the image formation process such as, for example, the charge level to which the charging device 20 electrostatically charges photoreceptor 10, the exposure level used by exposing device 30, the developer biases and TC used by developer device 40, the transfer and detack corona voltage and current levels, any pre-transfer corona treatment voltage or current level, or pre-transfer erase exposure levels, and the like. Additionally, the measured toner patch voltage can be used for diagnostic purposes as described above.

The mass of the toner patch can be estimated from readings provided by densitometer **90*b*. Densitometer 90*b* measures the mass of the toner patch while the toner patch is located on photoreceptor 10 and prior to transfer of the toner patch to transfer belt 50. Preferably, the mass of the toner patch located on transfer belt 50 is directly measured using a densitometer 90*a*. Densitometer 90*a* can be, for example, an IRD well known in the art (although not previously used to measure the mass of toner patches formed on a transfer member). Upon receiving the mass and voltage of the toner patch, controller 100 can then derive the charge to mass ratio from the empirically predetermined relationship between the toner mass, toner voltage and charge as, for example, described above. The toner charge can be used to control the charge level provided by charging device 20, the exposure level provided by exposing device 30, the developer bias or TC used by developer device 40, and the like. Additionally, knowledge of the triboelectric charge can be used to indicate whether the toner and/or developer device 40** require replacement.

In accordance with a second embodiment of the present invention, the mass of the toner patch located on transfer belt 50 and measured by densitometer **90*a* can be used without the toner patch voltage measured by ESV 80 for use by controller 100 in monitoring and controlling the toner formation process. For example, comparison of the toner patch mass on the belt 50 with a predetermined mass can be used to determine whether too much or too little toner is being transferred by the printing machine. Accordingly, operation of the charging device 20, exposing device 30, developer device 40 and/or the transfer belt 50 can be adjusted so that the mass of the toner patch transferred to belt 50 corresponds to the predetermined desired mass. Additionally, since the area of the toner patch is known, controller 100** can determine the transferred mass/area (TMA) from the measured mass of the toner patch on transfer belt.

The area of the toner patch is controlled, for example, by ROS 30 which forms the latent image for the toner patch on imaging member 10. The toner patch should be large enough to provide a suitable average reading. Preferably, the toner patch is at least 1 inch$^2$, although smaller patches may be formed.

When the printing machine includes a densitometer **90*b* located upstream of the toner transfer point, the DMA can also be determined and then used in conjunction with the TMA to determine the transfer efficiency (TE). That is, TE=TMA/DMA. In order to even more accurately derive the transfer efficiency, densitometer 90*c* can be provided downstream of the transfer point for measuring the mass of the toner patch remaining on photoreceptor 10 after transfer of the patch to transfer belt 50. The toner patch mass measured by densitometer 90*c* can be used by controller 100** to derive the residual mass/area (RMA). The RMA in conjunction with the TMA and/or DMA (since DMA=TMA+RMA) can be used to even more accurately derive the transfer efficiency, which can then be used to control the printing machine to form high quality, stable images. This additional accuracy with RMA measurement occurs because the RMA masses are generally much smaller than TMA, and density measurements are more sensitive (accurate) for lower toner masses than at higher masses where the optical densities tend to saturate.

Figure 5:
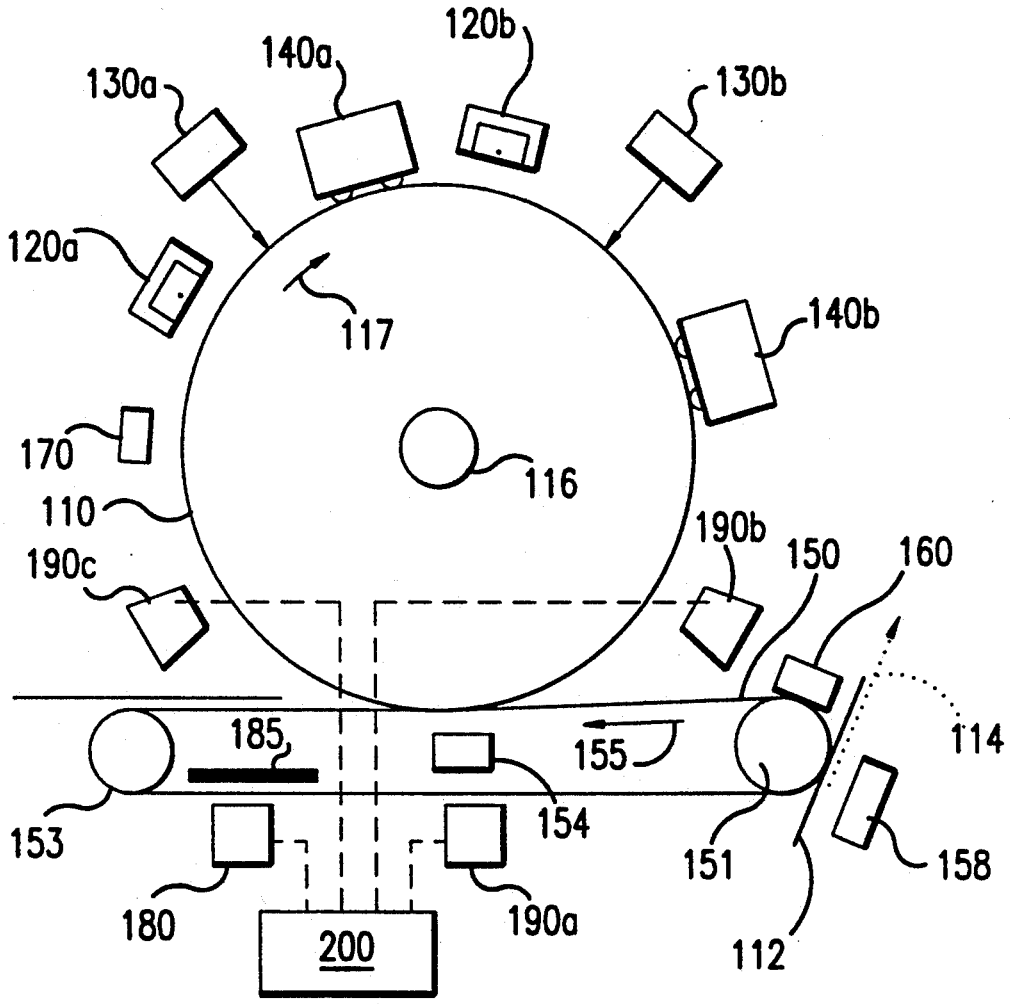
FIG. 5 is a schematic side view of pertinent portions of a color xerographic printing machine for forming two-color toner images on a drum-type photoreceptor which transfers the toner images to a belt-type transfer member which acts as an intermediate member for conveying toner images to a receiving material.

FIG. 5 illustrates a single-pass, two-color xerographic printing machine having a drum-type photoreceptor 110, and an intermediate transfer belt 150 for conveying the two-color toner image from photoreceptor 110 to a sheet of paper 112 conveyed past belt 150 in the direction of arrow 114. Photoreceptor 110 is mounted about shaft 116, and includes two charging devices **120*a*, 120*b*, two exposing devices 130*a*, 130*b*, and two developer devices 140*a*, 140*b* disposed around its periphery. Shaft 116 is driven to rotate photoreceptor 110 in the direction of arrow 117. After transfer of a toner image to intermediate belt 150, residual toner is removed from drum 110 by cleaning device 170, and then the photoreceptor is uniformly discharged for example, by an erase lamp (not shown) prior to its return to first charging device 120*a*. Intermediate belt 150 rotates in the direction of arrow 155 about rollers 151, 153, and conveys the toner image towards a sheet transfer station. The toner image is transferred from photoreceptor 110 to intermediate belt 150 by transfer corotron 154. Upon reaching sheet 112, the toner image is transferred to sheet 112, by second transfer corotron 158. Any residual toner on belt 150 is removed by cleaning device 160**.

As is understood, the photoreceptor could also be a belt which is then preferably used with an intermediate transfer drum so that there is generally a drum/belt interface at each transfer station.

Further, the intermediate member could be a chargeable belt wrapped around a drum.

For a more detailed description of xerographic printing machines having intermediate members (belts or drums) see, for example, U.S. Pat. Nos.: 3,893,761 to Buchan et al.; 3,923,392 to Buchan et al.; 3,947,113 to Buchan et al.; 4,708,460 to Langdon; 4,796,048 to Bean; 4,984,025 to Landa et al.; and 5,040,020 to Kamimura et al., the disclosures of which are incorporated herein by reference.

In order to monitor and control the image formation process in accordance with the first and/or second embodiments of the invention described above, the controller 200 of the printing machine is placed in communication with first, second and third densitometers **190*a*, 190*b*, 190*c* and ESV 180 (with or without back plate 185**). It is understood that the number of sensors provided depends on the measurements to be made.

Figure 6:
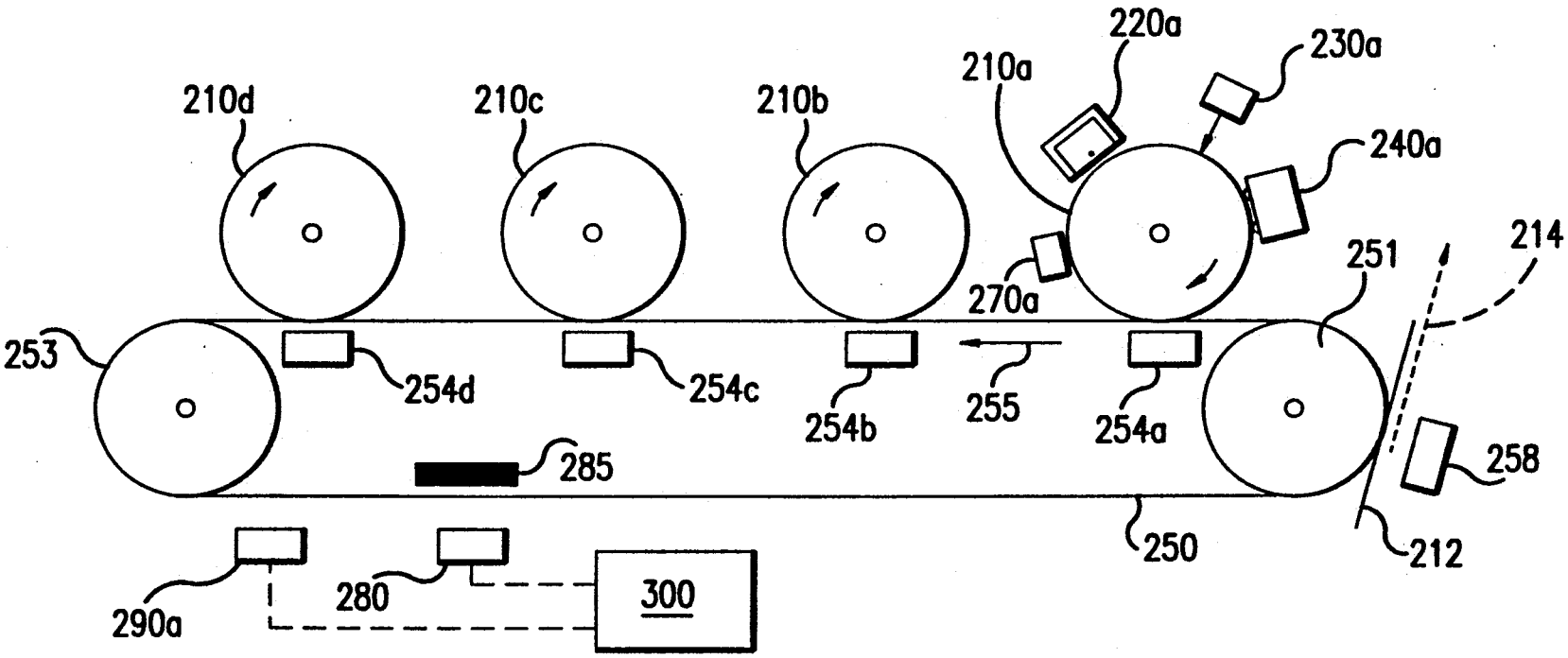
FIG. 6 is a side schematic view of a four color tandem-type color printer having a belt-type intermediate member.

FIG. 6 illustrates a multicolor printer having a plurality of print engines arranged in series, each of which transfer a different color toner image of a multicolor image to an intermediate transfer member. A first photoreceptor drum **210*a* includes a charging device 220*a*, an exposing device 230*a*, a developer device 240*a* and a cleaning device 270*a* disposed around its periphery. A single color toner image formed on first photoreceptor 210*a* is transferred to intermediate transfer belt 250 by first transfer corotron 254*a*. Belt 250 is wrapped around rollers 251, 253 which are driven to move belt 250 in the direction of arrow 255. Second, third and fourth photoreceptors 210*b*, 210*c*, 210*d*, which also include charging, exposing, developing and cleaning devices (not shown) are used to form and then transfer second, third and fourth single-color toner images to belt 250 (on top of each other) using transfer corotrons 254*b*, 254*c*, 254*d*. The multicolor image is then transferred to receiving material 212 (which moves in the direction of arrow 214) by corotron 258. Densitometer 290*a* and ESV 280 (with or without backplate 285) can be used to measure the mass and/or voltage of a toner patch transferred to belt 250 by each of the four photoreceptors 210*a–d* as discussed above. These measurements can be used by controller 300 as discussed above. Although not shown, densitometers can also be provided on each photoreceptor to measure DMA and RMA for that photoreceptor. An advantage of measuring the toner patch density on intermediate transfer belt 250 is that a single densitometer 290*a*** can make a measurement for all colors (i.e., for the color patches formed by each photoreceptor) instead of using a separate densitometer for each photoreceptor.

Figure 7:
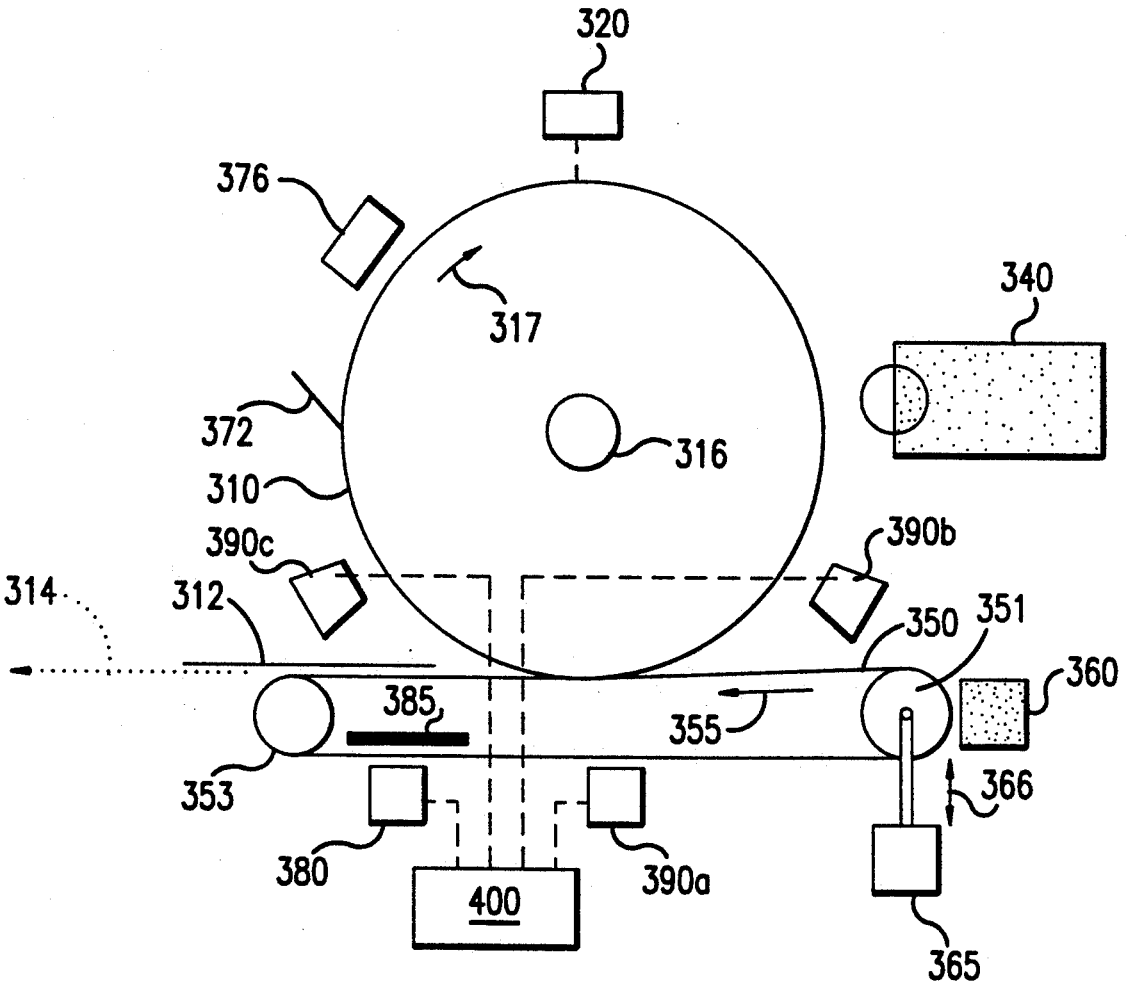
FIG. 7 is a side schematic view of an ionographic printing machine having a drum-type chargeable substrate and a belt-type transfer member which is selectively movable toward and away from the chargeable substrate.

FIG. 7 illustrates an ionographic printing machine having an architecture somewhat similar to the xerographic printing machine architecture illustrated in FIG. 1. In the ionographic printing machine of FIG. 7, the imaging member is a drum 310 having a chargeable surface. Drum 310 rotates about shaft 316 in the direction of arrow 317. The chargeable surface of drum 310 is selectively charged by projecting ions from an ion generating device 320 to form a latent image on drum 310. The latent image is developed by developer device 340 and then transferred to a sheet of paper 312 conveyed in the direction of arrow 314 past drum 310 by electrostatic transfer belt 350. Residual toner is removed from the surface of drum 310 by, for example, a scraper 372. Any charge remaining on the surface of drum 310 is then neutralized by an erase device 376 prior to formation of the next latent image on drum 310.

For a more detailed description of ionographic printing machines see, for example, U.S. Pat. Nos.: 4,524,371 to Sheridon et al.; 4,538,163 to Sheridon; 4,584,592 to Tuan et al.; 4,646,163 to Tuan et al.; 4,463,363 to Gundlach et al.; 4,644,373 to Sheridan et al.; 4,737,805 to Weisfied et al.; 4,839,670 to Snelling; and 5,081,476 to Genovese, the disclosures of which are incorporated herein by reference.

The transfer belt 350 is disposed around rollers 351, 353 which drive belt 350 in the direction of arrow 355. A cleaning device 360 is also provided to remove the toner patch from belt 350 as well as any additional toner which may inadvertently become adhered to belt 350 during regular image formation.

The image formation process is monitored and controlled by controller 400 in conjunction with the combinations of readings provided by densitometers 390*a*, 390*b*, 390*c* and ESV 380 (with or without back plate 385) as described above.

Additionally, densitometer 380*c* (as well as densitometers 90*c* and 190*c*) can be used to measure the mass of the toner patch before and after the toner patch is transferred to transfer belt 350 by providing spacing mechanism 365 which moves drive roller 351 in the direction of arrow 366 to selectively contact or space the transfer belt 350 from the surface of imaging member 310. After a toner patch is developed on imaging member 310 by developer device 340, spacing device 365 (which can be, for example, a servo motor or solenoid) is controlled to move transfer belt 350 away from imaging member 310. Accordingly, the toner patch is conveyed past transfer member 350 without being transferred thereto, and the mass is then measured by densitometer 390*c*. This measurement can be used to derive DMA as described above. Cleaning blade 372 is spaced away from drum 310 (or otherwise deactivated) so that the toner patch is not removed from drum 310 as drum rotates to recirculate the toner patch back to the transfer point between imaging member 310 and transfer belt 350. Prior to reaching the transfer point, spacing device 365 is actuated to move transfer belt 350 into contact with imaging member 310 so that the toner patch is transferred to transfer belt 350. Densitometer 390*c* is again used to measure the mass of the toner remaining on the imaging device 310, which measurement can now be used to derive RMA as described above. Alternatively, a second identical toner patch can be generated and then transferred and measured with densitometer 390*c* to determine RMA instead of requiring the toned patch to cycle around the drum and pass by the cleaning blade. Thus, RMA and DMA can be determined using a single densitometer 390*c*. TE can be derived from these readings since TE=(DMA−AMA)/DMA. The measurements made by densitometer 390*c* can be used alone or in combination with the readings made by densitometer 390*a* (i.e., TMA) and ESV 380 by controller 400 in the manner described above.

Although the illustrated embodiments show densitometer 90*a*, 190*a*, 290*a*, 390*a* located away from the point where transfer to the sheet (12, 112, 212, 312) takes place, the transfer densitometer could be positioned at other positions, such as, for example, at the top left of belt 50 or 350 (FIGS. 1 and 7), or to the right of belts 150 or 250 (FIGS. 5 and 6). When located at such a position, densitometer 90*a*, 190*a*, 290*a*, 390*a* can also measure the transferred toner patch mass on a sheet 12, 112, 212, 312 conveyed by belt 50, 150, 250, 350. This measurement could be used for calibration purposes.

While this invention has been described in conjunction with specific embodiments thereof, it is evident that many alternatives, modifications, and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A method for monitoring a toner image formation process performed by a printing machine having a chargeable imaging member, means for forming toner images on the imaging member, and an endless transfer member for transferring the toner images from the imaging member to a receiving member, said method comprising the steps of:

forming a toner patch on the imaging member with said means for forming toner images;

transferring said toner patch from said imaging member to said endless transfer member; and measuring a voltage potential of said toner patch located on said endless transfer member and measuring a mass of said toner patch.

2. The method of claim 1, wherein the voltage potential of said toner patch on said endless transfer member is measured with an electrostatic voltmeter.

3. The method of claim 1, wherein said endless transfer member is a transfer belt.

4. The method of claim 1, further comprising:

deriving a charge to mass ratio of the toner in said toner patch from said measured voltage potential and mass of the toner patch.

5. The method of claim 1, wherein the mass of the toner patch is measured while the toner patch is located on the endless transfer member.

6. The method of claim 5, wherein the mass of said toner patch on said endless transfer member is measured with a densitometer.

7. The method of claim 6, wherein said densitometer is located on an opposite side of said transfer member from said imaging member.

8. The method of claim 6, wherein said densitometer is located adjacent to said imaging member just downstream of a point where toner images are transferred to the transfer member from said imaging member.

9. The method of claim 5, further comprising deriving a transferred mass/area attribute for said patch from said measured mass.

10. The method of claim 9, further comprising controlling operating conditions of said printing machine based on the derived transferred mass/area attribute.

11. The method of claim 10, wherein the controlled operating conditions include a concentration of toner in a developer device which forms a part of said means for forming toner images.

12. The method of claim 10, wherein the controlled operating conditions include a charge potential to which said imaging member is charged for latent image formation.

13. The method of claim 10, wherein the controlled operating conditions include a developer bias of a developer device which forms a part of said means for forming toner images.

14. The method of claim 10, wherein the controlled operating conditions include an exposure level to which said imaging member is exposed for latent image formation.

15. The method of claim 5, further comprising measuring a mass of said toner patch located on said imaging member before said patch is transferred to said endless transfer member.

16. The method of claim 15, further comprising deriving a developed mass/area attribute for said patch from said mass measured on said imaging member before said patch is transferred to said endless transfer member.

17. The method of claim 15, further comprising deriving a transfer efficiency characteristic for the toner image formation process from said measured mass of the toner patch located on said endless transfer member and the measured mass of the toner patch located on said imaging member before the patch is transferred to said endless transfer member.

18. The method of claim 5, further comprising measuring a mass of residual toner from said toner patch remaining on said imaging member after said patch is transferred to said endless transfer member.

19. The method of claim 18, further comprising deriving a residual mass/area attribute for said residual toner from said mass measured on said imaging member after said patch is transferred to said endless transfer member.

20. The method of claim 15, further comprising measuring a mass of residual toner from said toner patch remaining on said imaging member after said patch is transferred to said endless transfer member.

21. The method of claim 20, further comprising deriving a transfer efficiency characteristic for the toner image formation process from said measured mass of the toner patch located on said endless transfer member, the measured mass of the toner patch located on said imaging member before the patch is transferred to said endless transfer member, and the measured mass of the residual toner remaining on said imaging member after said patch is transferred to said endless transfer member.

22. A method for monitoring a toner image formation process performed by a printing machine having a chargeable imaging member, means for forming toner images on the imaging member, and an endless transfer member for transferring the toner images from the imaging member to a receiving member, said method comprising the steps of:

forming a toner patch on the imaging member with said means for forming toner images;

conveying said patch past a transfer point between the imaging member and the transfer member, with the imaging member and the transfer member spaced apart from each other so that the patch is not transferred from said imaging member to said endless transfer member; and measuring a mass of said toner patch located on said imaging member.

23. The method of claim 22, further comprising:

transferring said toner patch from said imaging member to said endless transfer member; and measuring a mass of residual toner from said toner patch remaining on said imaging member after said patch is transferred to said endless transfer member.

24. The method of claim 23, further comprising deriving a transfer efficiency characteristic for the toner image formation process from said measured mass of the residual toner remaining on said imaging member after said patch is transferred to the endless transfer member and the measured mass of the toner patch located on said imaging member before the patch is transferred to said endless transfer member.

25. A printing machine comprising:

a chargeable imaging member;

means for forming toner images on the imaging member;

an endless transfer member for transferring the toner images from the imaging member to a receiving member;

measuring means for measuring a voltage potential of a toner patch located on said endless transfer member, said toner patch having been transferred to the endless transfer member from the imaging member after having been formed by the means for forming toner images on the imaging member, said measuring means also including means for measuring a mass of the toner patch; and means for monitoring a toner image formation process performed by the printing machine based on the measured voltage potential and mass of the toner patch.

26. The printing machine of claim 25, wherein said measuring means includes an electrostatic voltmeter for measuring said voltage potential.

27. The printing machine of claim 25, wherein said measuring means includes a densitometer for measuring the mass of the toner patch.

28. The printing machine of claim 27, wherein said densitometer is located upstream of a transfer point where the patch is transferred to the transfer member so that the mass of the toner patch is measured while the toner patch is located on the imaging member.

29. The printing machine of claim 27, wherein said densitometer is located adjacent to the transfer member so that the mass of the toner patch is measured after the toner patch is transferred to the endless transfer member.

30. The printing machine of claim 25, wherein said means for monitoring includes means for deriving a charge to mass ratio of the toner in said toner patch from said measured voltage potential and mass of the toner patch.

31. The printing machine of claim 25, wherein said measuring means for measuring the toner patch mass measures a mass of the toner patch located on said endless transfer member.

32. The printing machine of claim 31, wherein said measuring means for measuring the toner patch mass includes a densitometer located on an opposite side of said transfer member from said imaging member.

33. The printing machine of claim 31, wherein said measuring means for measuring the toner patch mass includes a densitometer located adjacent to said imaging member just downstream of a point where toner images are transferred to the transfer member from said imaging member.

34. The printing machine of claim 31, wherein said means for monitoring includes means for deriving a transferred mass/area attribute for said patch from said measured mass.

35. The printing machine of claim 31, wherein said measuring means also includes means for measuring a mass of said toner patch located on said imaging member before said patch is transferred to said endless transfer member.

36. The printing machine of claim 35, wherein said means for monitoring also includes means for deriving a transfer efficiency characteristic for the toner image formation process from said measured mass of the toner patch located on said endless transfer member and the measured mass of the toner patch located on said imaging member before the patch is transferred to said endless transfer member.

37. The printing machine of claim 31, wherein said measuring means also includes means for measuring a mass of residual toner from said toner patch remaining on said imaging member after said patch is transferred to said endless transfer member.

38. The printing machine of claim 37, wherein said means for monitoring also includes means for deriving a transfer efficiency characteristic for the toner image formation process from said measured mass of the toner patch located on said endless transfer member and the measured mass of the residual toner remaining on said imaging member after said patch is transferred to said endless transfer member.

39. The printing machine of claim 25, wherein said endless transfer member is a transfer belt.

40. The printing machine of claim 25, wherein said means for forming toner images on the imaging member includes a charging device for charging the imaging member to a uniform voltage potential, an exposing device for exposing the uniformly charged imaging member to a modulated light image so as to selectively discharge portions of the imaging member to form a latent image, and a developer device for toner developing the latent image into the toner image.

41. The printing machine of claim 25, wherein said means for forming toner images on the imaging member includes an ion generating device for selectively charging the imaging member to form a latent image on the imaging member, and a developer device for toner developing the latent image into the toner image.

42. A printing machine comprising:

a chargeable imaging member;

means for forming toner images on the imaging member;

an endless transfer member for transferring the toner images from the imaging member to a receiving member;

spacing means for moving said imaging member and said transfer member apart from each other so that said imaging member and said transfer member can be selectively spaced apart from each other; and a densitometer located downstream of a point where toner images are transferred from the imaging member to the transfer member for measuring the mass of a toner patch located on said imaging member prior to transfer when said imaging member and said transfer member are spaced from each other by said spacing means, and for measuring a mass of residual toner remaining on the imaging member after the toner patch has been transferred to the endless transfer member from the imaging member when said imaging member and said transfer member are not spaced from each other by said spacing means.

43. A method for monitoring a toner image formation process performed by a printing machine having a chargeable imaging member, means for forming toner images on the imaging member, and an endless transfer member for transferring the toner images from the imaging member to a receiving member, said method comprising the steps of:

forming a toner patch on the imaging member with said means for forming toner images;

transferring said toner patch from said imaging member to said endless transfer member; and measuring a voltage potential of said toner patch located on said endless transfer member.

44. The method of claim 43, wherein the voltage potential of said toner patch on said endless transfer member is measured with an electrostatic voltmeter.

45. The method of claim 43, wherein said endless transfer member is a transfer belt.

46. A printing machine comprising:

a chargeable imaging member;

means for forming toner images on the imaging member;

an endless transfer member for transferring the toner images from the imaging member to a receiving member;

measuring means for measuring a voltage potential of a toner patch located on said endless transfer member, said toner patch having been transferred to the endless transfer member from the imaging member after having been formed by the means for forming toner images on the imaging member; and means for monitoring a toner image formation process performed by the printing machine based on the measured voltage potential of the toner patch.

47. The printing machine of claim 46, wherein said measuring means includes an electrostatic voltmeter.

* * * * *